United States Patent [19]

Bahm

[11] Patent Number: 4,770,385

[45] Date of Patent: Sep. 13, 1988

[54] SELF-LOCKING TRIAD SUPPORT

[75] Inventor: Glenn A. Bahm, 14714 F. Perthshire, Houston, Tex. 77079

[73] Assignee: Glenn A. Bahm, Inc., Houston, Tex.

[21] Appl. No.: 916,398

[22] Filed: Oct. 6, 1986

[51] Int. Cl.[4] ..... A47G 29/02

[52] U.S. Cl. ..... 248/293; 248/461; 248/298

[58] Field of Search ..... 248/293, 240.2, 461, 248/463, 298, 447, 455, 457; 108/35, 6; 281/33, 45

[56] References Cited

U.S. PATENT DOCUMENTS

| | | | |
|---|---|---|---|
| 1,318,257 | 10/1919 | Blaustein | 248/293 X |
| 1,957,039 | 5/1934 | Beunger et al. | 281/33 |
| 1,990,103 | 2/1935 | van Alstyne | 248/447 |
| 2,355,653 | 8/1944 | Joyce | 248/447 |
| 2,881,008 | 4/1959 | Goldman | 281/33 |
| 3,164,353 | 1/1965 | René | 108/6 |
| 3,455,461 | 7/1969 | Kesling | 248/293 X |

FOREIGN PATENT DOCUMENTS

| | | | |
|---|---|---|---|
| 793630 | 11/1935 | France | 248/463 |

*Primary Examiner*—Ramon S. Britts
*Assistant Examiner*—Karen J. Chotkowski
*Attorney, Agent, or Firm*—Hovey, Williams, Timmons & Collins

[57] ABSTRACT

An art board support comprising a solid leg plate pivotally attached on one end to the internal rim of a base plate aperture, and on the opposite end, pivotally attached to a U-shaped leg plate, in cross-section. The opposite end of the U-shaped leg plate is secured to the base plate by lateral sliding members. The two legs combined with the base plate form a triad, when in the open position, whereby downward pressure maintains the legs in a locked position. In the closed position, the leg assembly is secured by a latch assembly being recessed in the base plate aperture.

5 Claims, 2 Drawing Sheets

SELF-LOCKING TRIAD SUPPORT

The present invention generally relates to an art board support and more particularly concerned with a retractable, self-locking, multi-pintle support adapted to incline the surface of an art board at a suitable angle when placed on a table top or other flat surface. The support is composed of two legs pivotally connected at one end and at the other end, attached to a base plate. In the open position, the legs angle apart at the base plate forming a triad configuration which locks the legs in position. In the closed position, the legs retract into the mounting plane of the base plate and are secured by a spring latch.

BACKGROUND OF THE INVENTION

In contemporary art boards, most do not have attached support elements to incline the board at an angle. These boards are sometimes placed on an inclined framework. The extra piece of equipment gives one more item to keep track of and is a disadvantage.

Of the portable art boards with attached support elements on the underside to incline the board at an angle, most are not very sturdy and are subject to collapse when accidentally jolted from the side or oblique position. This instability, or fear of it, is a limiting factor in one's work.

Art boards with attached support elements usually incline the board in the horizontal direction only, since the design of the support mechanism limits its placement in relation to the direction of the incline and this is disadvantageous.

SUMMARY OF THE INVENTION

Accordingly, it is an important object of the present invention to provide an art board support that is permanently attached to the underside of the board, that is sturdy, yet easily recessed into the plane of the base plate, resulting in a generally level surface of the underside and also protecting the legs from damage when recessed and not in use.

Another object of the present invention is to produce a support element which is self-locking to prevent accidental collapse due to unexpected movement of the board in any direction.

A further objective of the present invention is to provide a support which is simple in design, functional, and has transverse structural characteristics.

Another embodiment of the present invention is to provide an art board support which adapts the board for use in either a horizontal or vertical direction by the use of multiple support elements and that they can be placed at any angle in relationship to the slant or board position.

Other objects of the invention will become more apparent from the following description and the accompanying drawings.

In carrying out the invention, the self-locking triad support is composed of a planal base plate containing an aperture thereon, characterized by an interior rectangular rim to which is pivotally attached a solid leg plate. The opposite end of the solid leg plate is pivotally attached to a U-shaped, in cross-section, leg plate conterminous with said solid leg plate, when in the closed position, forming an integral unit, a leg plate assembly, which recesses into the base plate concavity, resulting in a space saving means, protecting the leg assembly when not in use. The opposite end of the U-shaped leg plate is pivotally attached to lateral sliding members, which are preferably of a material to reduce surface friction and to facilitate manual movement to the open and closed position. The lateral sliding members are movably guided by lateral channels parallel to the base plate plane. When in the open position, the two leg plates being pivotally attached at one end, form a triad shape with the base plate plane whereby, pressure on the support legs is transmitted to the base plate rim, locking the support in the open position. Use of leg plates connected at the six common corners to form the triad shape imparts a transverse stabilizing factor that resists torque motion and stress from many angles and gives greater strength to the support legs while having the property of being compressed into a minimum area when recessed in the closed position. This allows the support unit to be positioned in any direction on the underside of the inclined board.

DETAILED DESCRIPTION OF THE INVENTION

Figure 1:
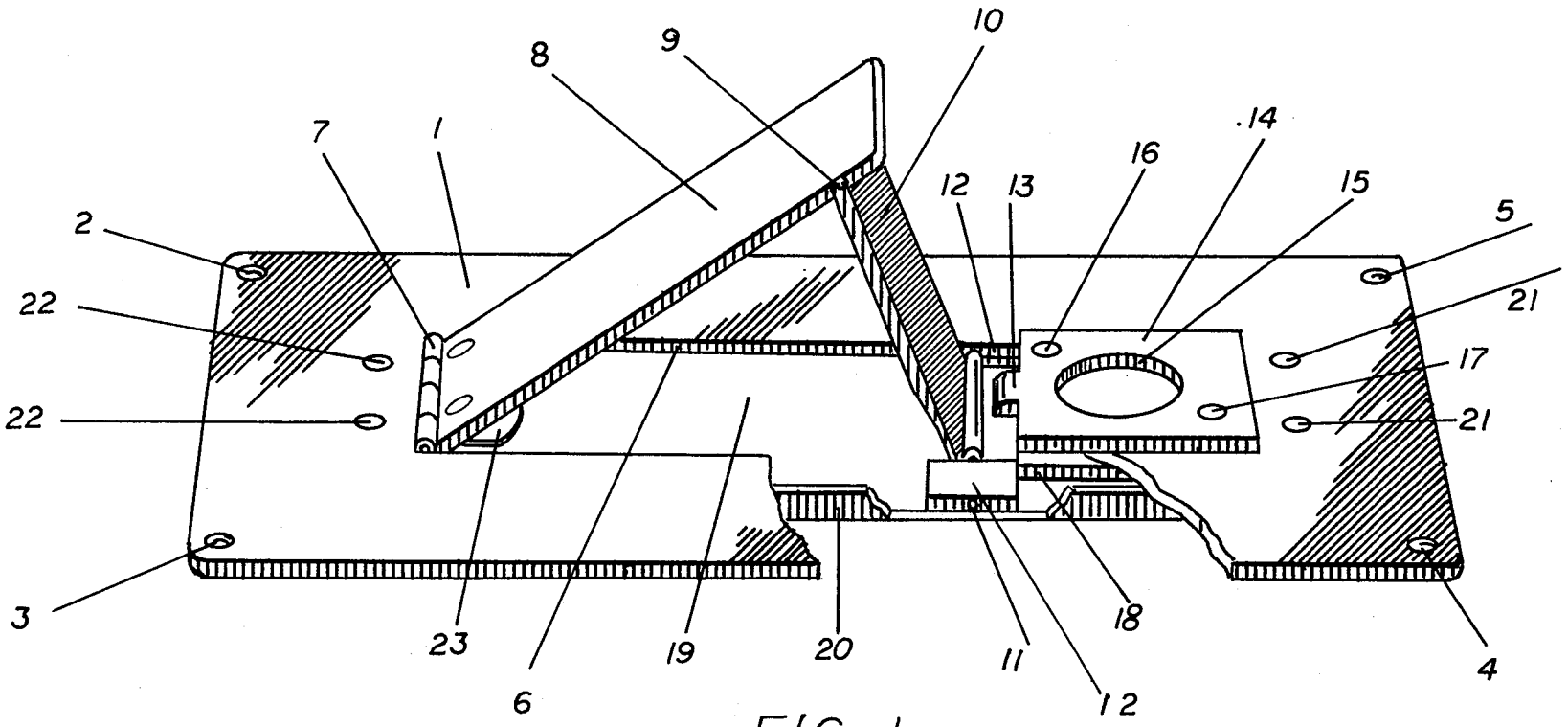
FIG. 1 is a perspective view of the self-locking triad support in the open, locked position with cut-away view of the sliding members and bottom pan.

The perspective drawing of the support in the open, locked position, FIG. 1, designates the base plate 1 and the bores, 2, 3, 4, and 5, for attachment to the art board. Said base plate, containing an aperture thereon with interior rim 6, to which is connected a solid leg plate 8, pivotally connected to base plate 1 on one end portion and on the opposite end portion pivotally connected 9 to a U-shaped leg plate 10. The opposite end portion of the U-shaped leg plate is pivotally connected 11 to a lateral sliding member 12. To recess the support into the concavity 19 of the base plate 1, a manual pressure is applied to the U-shaped leg plate at a point adjacent to the base plate and in a direction opposite the latch 14, whereby the U-shaped leg plate rotates under the solid leg plate, superposes around it forming a leg assembly which recesses into the concavity 19 of the base plate 1 and the leading edge of plate 8 being secured by latch lip 13. In the closing motion, the lateral sliding members, 12, move linearly in the direction away from the latch assembly 14 and are retained by lateral channels formed by the interior rim of the base plate, 6, the bottom pan 19, and sidewalls 20. The bottom pan is attached to the base plate 1 by 21 and 22 utilizing spacers at each end 32 and 33.

Figure 2:
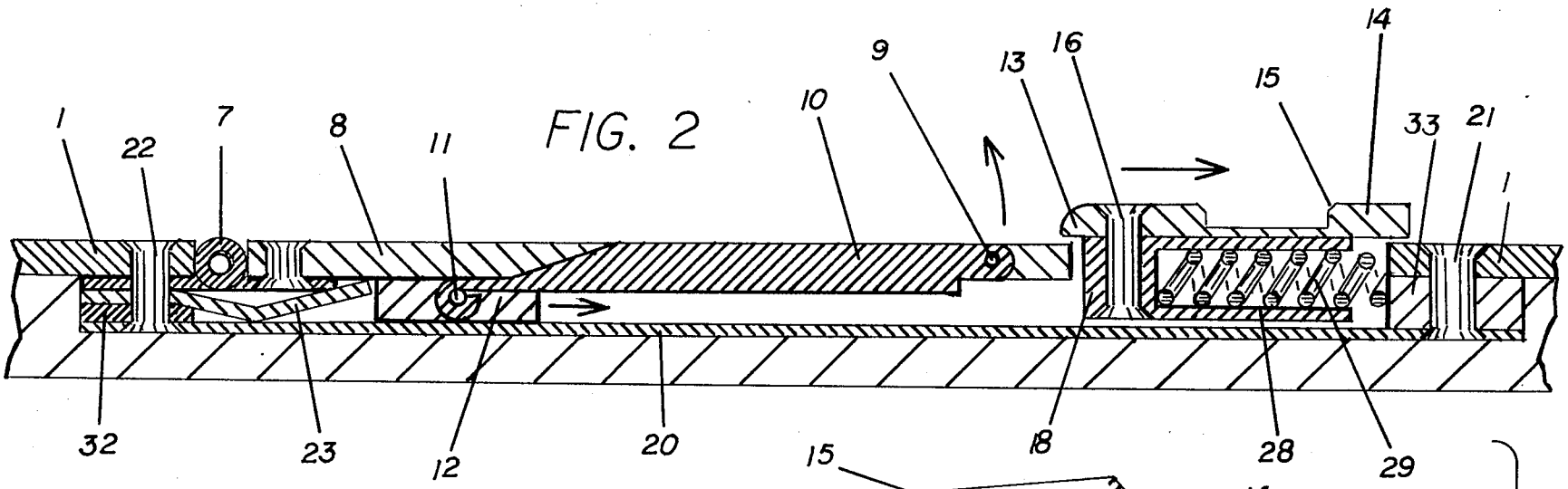
FIG. 2 is a cross-sectional view of the support in the closed or recessed position.

The support, in the recessed, closed position, FIG. 2, is opened by a linear movement of the latch assembly 14, in the direction of the arrow by means of a finger recess 15. This movement compresses spring 29, contained within spring cavity 28, against abuttment formed by base plate 1 and spacer 33.

Figure 3:
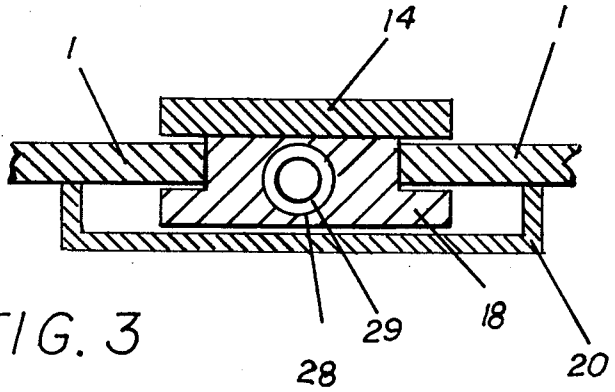
FIG. 3 is a cross-sectional view transverse to FIG. 2 showing latch assembly in relationship to the base plate and bottom pan.

The latch assembly, FIG. 3, shown in cross section, contains two lateral channels formed by top latch plate 14 and bottom latch plate 18, into which the base plate rim, 1, extends.

Figure 4:
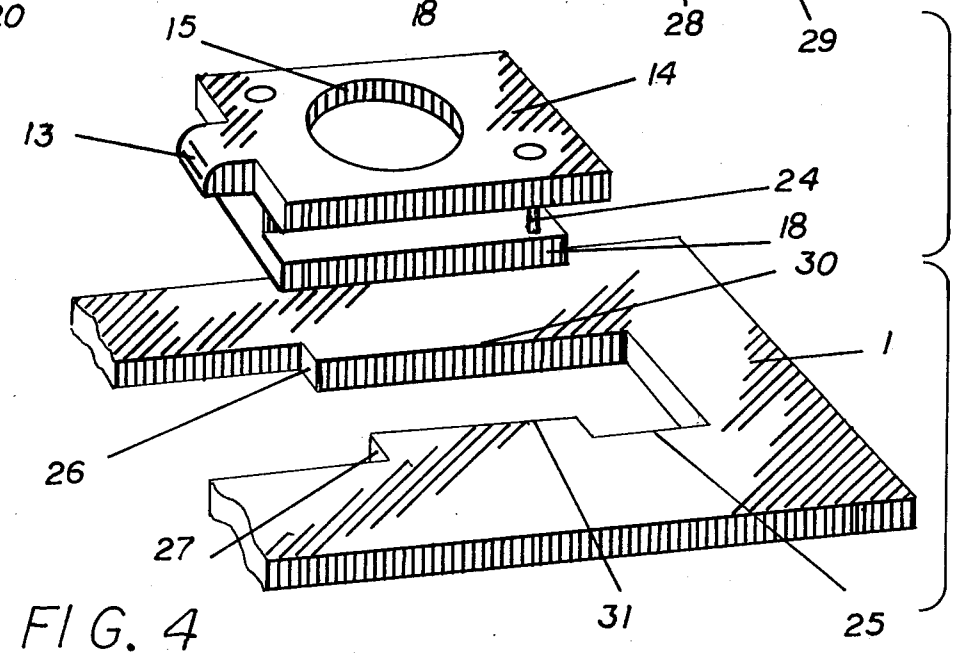
FIG. 4 is a perspective view of the latch assembly in relation to the base plate.

The latch assembly, FIG. 4 is retained on the base plate rim 30 and 31 by a stop means or pin 24, allowing movement within the confines of recess 25 to prevent assembly movement beyond 26 and 27.

When latch assembly lip, 13, releases leg assembly 8 and 10, spring plate 23 urges it to rotate upward from pivot point 7, causing U-shaped leg plate 10 to rotate downward at pivot point 9 while the opposite end of the U-shaped leg plate, containing lateral sliding members, 12, being retained by lateral channels, moves forward in the direction of the arrow, rotating at pivot point 11. A triad figure is formed by the two leg plates and the base plate plane. As the solid leg plate 8 rotates upward from pivot point 7, the U-shaped plate angles toward the latch assembly, pivot point 9, with the lateral sliding members coming to rest against a barrier means or front wall of the latch assembly 18, thus locking the support in place as can be seen, for example, in FIG. 1. Pressure on the support is then transferred to the base plate rim.

The disclosure of the invention described herein represents the preferred embodiments of the invention; however, variations thereof, in the form, construction, and arrangement of the various components thereof and the modified application of the invention are possible without departing from the spirit and scope of the appended claims.

What is claimed is:

1. A self-locking triad support system comprising:

a base plate having an interior, generally rectangular rim means defining an aperture and lateral channels generally parallel to said base plate;

a first leg plate pivotally connected to said rim means;

a second leg plate substantially conterminous with said first leg plate and pivotally coupled to the latter;

said second leg plate having a U-shaped configuration in cross section;

said second leg plate being movable to a position embracing said first leg plate to form a leg plate assembly which is recessed into said aperture adjacent said rim means;

lateral sliding members pivotally connected to said second leg plate and being slidable in said channels;

a latch assembly having lateral grooves receiving said rim means of said base plate;

stop means carried by said latch assembly and associated with said lateral grooves;

said aperture of said base plate including a recess;

said stop means being shiftable within the confines of said recess for limited movement of the latch assembly;

first spring means urging said latch assembly toward said first leg plate and said second leg plate, said latch assembly including a lip engageable with said leg plate assembly for retaining the latter in said recessed position; and second spring means disposed adjacent said first leg plate and said base plate for biasing said leg plate assembly away from said recessed position;

said lateral sliding members being movable in said channels toward an open position abutting said latch assembly;

said first leg plate, said second leg plate, and said base plate, when said sliding members are moved to said position abutting said latch assembly, forming a triad configuration operable as a transverse structural element.

2. A low profile, triad support system comprising:

a base plate having means defining an aperture;

a first elongated leg;

first pivot means interconnecting said first leg and said means defining said aperture for movement of said first leg relative to said base plate in an arc toward and away from a position substantially within said aperture;

a second elongated leg;

second pivot means coupling said second leg to said first leg at a position remote from said first pivot means for swinging movement of said second leg relative to said first leg in an arc toward and away from a position of side-by-side, generally parallel relationship with said first leg forming a leg plate assembly disposed substantially within said aperture;

guide means connected to said second leg at a position remote from said second pivot means and including a member shiftably connected to said base plate adjacent said means defining said aperture for guiding the movement of said second leg as said first leg and said second leg are moved in said respective arcs;

barrier structure disposed adjacent said means defining said aperture at a position remote from said first pivot means;

said guide means being shiftable toward said first pivot means as said first leg is moved toward a position substantially within said aperture, for causing said second leg to be moved toward said position of side-by-side, generally parallel relationship with said first leg substantially within said aperture;

said guide means being shiftable away from said first pivot means and toward said barrier structure for causing one of said guide means and said second leg to contact said barrier structure;

said first leg, said second leg and said base plate, when one of said second leg and said guide means is in said position of contact with said barrier structure, forming a triad configuration operable to support said base plate in an inclined orientation;

latch means for releasably retaining said first leg in said position substantially within said aperture with said second leg in said position of generally parallel, side-by-side relationship with said first leg;

said latch means including walls shiftably connected with said means defining said aperture for movement of said latch means generally within said aperture; and means for limiting the movement of said latch means within said aperture;

said latch means including a lip engageable with one of said first leg and said second leg for retaining said first leg in said position substantially within said aperture.

3. The invention as set forth in claim 2, and including spring means for biasing said first leg away from a position parallel with said base plate.

4. The invention as set forth in claim 2, wherein said latch means is fixedly connected to said barrier structure.

5. The invention as set forth in claim 2, wherein said means defining said aperture further defines a channel receiving said member of said guide means for sliding movement therein.

* * * * *